US011460789B2

(12) United States Patent
Otsuru et al.

(10) Patent No.: US 11,460,789 B2
(45) Date of Patent: Oct. 4, 2022

(54) CHARGING ROLLER AND IMAGE FORMING APPARATUS

(71) Applicant: BRIDGESTONE CORPORATION, Tokyo (JP)

(72) Inventors: Makoto Otsuru, Tokyo (JP); Kaori Okumoto, Tokyo (JP)

(73) Assignee: Archem Inc., Tokyo (JP)

( * ) Notice: Subject to any disclaimer, the term of this patent is extended or adjusted under 35 U.S.C. 154(b) by 0 days.

(21) Appl. No.: 17/413,572

(22) PCT Filed: Dec. 12, 2019

(86) PCT No.: PCT/JP2019/048740

§ 371 (c)(1),
(2) Date: Jun. 14, 2021

(87) PCT Pub. No.: WO2020/129814

PCT Pub. Date: Jun. 25, 2020

(65) Prior Publication Data

US 2022/0066350 A1 Mar. 3, 2022

(30) Foreign Application Priority Data

Dec. 17, 2018 (JP) ..... JP2018-235784

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
See application file for complete search history.

(56) References Cited

U.S. PATENT DOCUMENTS

| | | | | |
|---|---|---|---|---|
| 7,526,239 | B2 | 4/2009 | Kawano et al. | |
| 7,833,607 | B2 | 11/2010 | Kawano et al. | |
| 8,991,053 | B2 * | 3/2015 | Watanabe | B05D 5/00 29/895.32 |
| 9,904,199 | B2 * | 2/2018 | Terada | G03G 15/0233 |
| 9,939,750 | B2 | 4/2018 | Narita et al. | |
| 10,442,169 | B2 | 10/2019 | Osaku et al. | |

(Continued)

FOREIGN PATENT DOCUMENTS

| | | |
|---|---|---|
| CN | 1643405 A | 7/2005 |
| CN | 1881105 A | 12/2006 |

(Continued)

OTHER PUBLICATIONS

Feb. 10, 2020, International Search Report issued in the International Patent Application No. PCT/JP2019/048740.

(Continued)

*Primary Examiner* — Ryan D Walsh
(74) *Attorney, Agent, or Firm* — Kenja IP Law PC

(57) ABSTRACT

A charging roller comprises a shaft member, a base layer located outside in the radial direction of the shaft member, and a surface layer located outside in the radial direction of the base layer and forming a surface. The surface layer includes particles, and the ratio of the total area of the particles exposed from the surface of the surface layer in a planar view seen from the radial direction of the charging roller, with respect to the area of the surface of the surface layer is more than 60%.

15 Claims, 1 Drawing Sheet

(56) References Cited

U.S. PATENT DOCUMENTS

| | | | | |
|---|---|---|---|---|
| 2004/0240910 | A1 | 12/2004 | Koyanagi et al. | |
| 2011/0002711 | A1* | 1/2011 | Wada | G03G 15/0233 399/176 |
| 2014/0178110 | A1* | 6/2014 | Yagi | G03G 15/1605 399/302 |
| 2015/0003874 | A1* | 1/2015 | Aoyama | G03G 15/0233 399/176 |
| 2017/0355178 | A1 | 12/2017 | Sano | |
| 2018/0011415 | A1 | 1/2018 | Narita et al. | |
| 2018/0136578 | A1 | 5/2018 | Wu et al. | |
| 2018/0275552 | A1 | 9/2018 | Satoh et al. | |
| 2018/0364604 | A1* | 12/2018 | Fujino | G03G 15/0233 |
| 2019/0346788 | A1* | 11/2019 | Fujino | G03G 15/0233 |
| 2020/0064754 | A1 | 2/2020 | Sano et al. | |
| 2020/0166865 | A1 | 5/2020 | Osaku et al. | |

FOREIGN PATENT DOCUMENTS

| | | | | |
|---|---|---|---|---|
| CN | 106457802 | A | 2/2017 | |
| CN | 107206775 | A | 9/2017 | |
| CN | 107589641 | A | 1/2018 | |
| CN | 108427254 | A | 8/2018 | |
| CN | 108602336 | A | 9/2018 | |
| JP | H10268643 | A | 10/1998 | |
| JP | 2001318511 | A | 11/2001 | |
| JP | 2002207362 | A | 7/2002 | |
| JP | 2003316111 | A | 11/2003 | |
| JP | 2004170939 | A | 6/2004 | |
| JP | 2004309910 | A | 11/2004 | |
| JP | 2006023726 | A | 1/2006 | |
| JP | 2006023727 | A | 1/2006 | |
| JP | 2007279419 | A | 10/2007 | |
| JP | 2012181226 | A | 9/2012 | |
| JP | 2013120356 | A | 6/2013 | |
| JP | 2017032821 | A | 2/2017 | |
| JP | 2018005116 | A | 1/2018 | |
| WO | WO-2013101819 | A1 * | 7/2013 | G03G 15/0233 |
| WO | 2018168584 | A1 | 9/2018 | |

OTHER PUBLICATIONS

Jun. 16, 2021, International Preliminary Report on Patentability issued in the International Patent Application No. PCT/JP2019/048740.

Jun. 24, 2022, search result of Office Action issued by the China National Intellectual Property Administration in the corresponding Chinese Patent Application No. 201980083643.8.

Aug. 23, 2022, search result of the Extended European Search Report issued by the European Patent Office in the corresponding European Patent Application No. 19899542.5.

* cited by examiner

CHARGING ROLLER AND IMAGE FORMING APPARATUS

TECHNICAL FIELD

The present disclosure relates to charging rollers and image forming apparatuses.

The present application claims priority to Patent Application No. 2018-235784 filed in Japan on Dec. 17, 2018, the contents of which are hereby incorporated by reference in their entirety.

BACKGROUND

Conventionally, in image forming apparatuses using an electrophotographic system, such as copying machines, printers, and facsimiles, a printing method is employed in which, first, the surface of a photoreceptor is uniformly charged, an image is projected from an optical system onto this photoreceptor, an electrostatic latent image is provided by an electrostatic latent image process for forming a latent image by eliminating the charge from the portion exposed to light, subsequently, a toner image is formed by adsorption of toner, and the toner image is transferred onto a recording medium such as paper.

Here, a charging roller is generally used for charging the surface of the photoreceptor, that is, the photosensitive drum. Specifically, in minute gaps formed when the charging roller is caused to abut on the photoreceptor, discharge occurs from the charging roller to which a voltage is applied to the photoreceptor, and thereby, the surface of the photoreceptor is uniformly charged.

CITATION LIST

Patent Literature

PTL 1: Japanese Patent Application Laid-Open No. 2013-120356

SUMMARY

Technical Problem

However, in a conventional charging roller, uneven charging may occur on the surface of the photoreceptor, thereby causing microjitter, that is, horizontal streaks, during printing on a recording medium such as paper. Such microjitter has been conventionally resolved by controlling the particle size, shape, amount to be blended, and the like of particles to be contained in the surface layer of the charging roller, as in, for example, PTL 1. However, even such a charging roller cannot be said to be sufficient for eliminating microjitter, and a further improvement has been required.

It is thus an object of the present disclosure to provide a charging roller capable of sufficiently reducing microjitter and an image forming apparatus capable of sufficiently reducing microjitter.

Solution to Problem

A charging roller of the present disclosure is a charging roller comprising a shaft member, a base layer located outside in the radial direction of the shaft member, and a surface layer located outside in the radial direction of the base layer and forming a surface, wherein the surface layer includes particles, and the ratio of the total area of the particles exposed from the surface of the surface layer in a planar view seen from the radial direction of the charging roller, with respect to the area of the surface of the surface layer is more than 60%.

The image forming apparatus of the present disclosure comprises the charging roller described above.

Advantageous Effect

According the present disclosure, it is possible to provide a charging roller capable of sufficiently reducing microjitter and an image forming apparatus capable of sufficiently reducing microjitter.

DETAILED DESCRIPTION

Hereinafter, one embodiment of the present disclosure will be illustrated and described with reference to the drawings.

Figure 1:
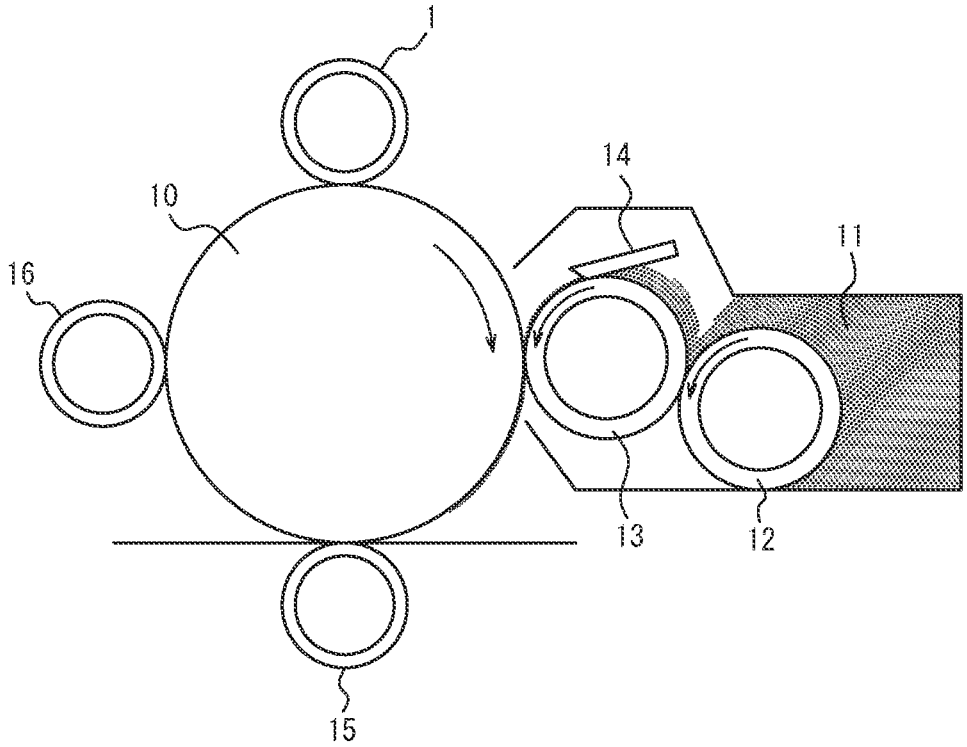
FIG. 1 is a schematic view illustrating an image forming apparatus according to one embodiment of the present disclosure.

A charging roller of the present embodiment can be used in an image forming apparatus, for example, a laser printer, as illustrated in FIG. 1. As illustrated in the cross-sectional view in the axis direction of FIG. 2, a charging roller 1 comprises a shaft member 2, a base layer 3 located outside in the radial direction of the shaft member 2, and a surface layer 4 located outside in the radial direction of the base layer 3 and forming the surface of the charging roller 1.

In the charging roller 1 of the present embodiment, the layer to be formed on the shaft member 2 is not limited to the base layer 3 and surface layer 4. Other layers of a single layer or a plurality of layers may be optionally formed between the base layer 3 and the surface layer 4 and between the shaft member 2 and the base layer 3.

The surface layer 4 of the charging roller 1 of the present embodiment includes particles, and the ratio of the total area of the particles exposed from the surface of the surface layer 4 in a planar view seen from the radial direction of the charging roller 1, with respect to the area of the surface layer 4, which ratio is also referred to as the "particle exposure area ratio" hereinafter, is more than 60%.

In this manner, when the charging roller 1 is brought into contact with a photoreceptor in order to charge the photoreceptor, a large number of the particles on the surface of the surface layer 4 abuts on the surface of the photoreceptor to thereby make minute gaps, that is, clearances, which are formed supported by the large number of the particles, easily present uniformly and entirely between the charging roller 1 and the photoreceptor. Then, discharge occurs uniformly from the charging roller 1 to which a voltage is applied to the photoreceptor, in the minute gaps, that is, clearances, uniformly present. Thus, the surface of the photoreceptor is uniformly charged, and microjitter can be sufficiently reduced.

When the particle exposure area ratio is 60% or less, the minute gaps described above are unlikely to be sufficiently uniform, and thus, it is not possible to sufficiently reduce microjitter.

In the present embodiment, the particle exposure area ratio is preferably 70% or more, from a similar viewpoint as described above. Although the larger ratio is more preferred, the upper limit value is preferably 85% or less from the viewpoint of toner contamination.

In the present disclosure, the total area of the particles exposed from the surface of the surface layer 4 is obtained using photographs, at a magnification of 1000 times, of three points: the center and both ends, which are positions 30 mm distant inward from each end of the surface layer 4, in the axis direction of the surface layer 4, taken by a laser microscope from the radial direction of the charging roller 1. Specifically, the photographs at a magnification of 1000 times taken by a laser microscope are binarized using image processing software such that portions identified as particles are displayed black. The total area of the portions displayed black is calculated, and the total areas obtained from the photographs of the three points are arithmetically averaged to thereby obtain the total area of the particles exposed from the surface of the surface layer 4.

The ratio of the total area of the particles exposed from the surface of the surface layer 4 in a planar view seen from the radial direction of the charging roller 1, with respect to the area of the surface layer 4 is obtained by dividing the total area obtained by the above method by the photographed area of the photographs at a magnification of 1000 times.

The portions identified as the particles in the photographs at a magnification of 1000 times taken by a laser microscope are portions identified to be more projecting in the photographs than the portions at which the surface of the surface layer 4 is flat. When the surface of the particles is coated, the particles in the present disclosure also include a coating portion and the particle exposure area ratio is calculated with the coating portion included.

In the present embodiment, the particles to be included in the surface layer 4 are not particularly limited, but are preferably formed of at least one resin selected from the group consisting of an acrylic resin, a polyamide resin, and a melamine resin. Thereby, it is possible to sufficiently reduce microjitter.

Additionally, from the viewpoint of microjitter, the particles are more preferably formed of an acrylic resin.

In the present embodiment, the average particle size of the particles is preferably from 3 to 20 μm, more preferably from 6 to 18 μm, and further preferably from 10 to 18 μm. When the average particle size of the particles is set to 3 μm or more, minute gaps are easily formed sufficiently uniformly on the surface layer 4 while the distance of the minute gaps between the charging roller 1 and the photoreceptor appropriate. In the case where the average particle size of the particles is excessively large, discharge from the charging roller to the photoreceptor does not occur in particles having a large particle size and a phenomenon referred to as a white void may occur. As a result, the image resolution may decrease. However, when the average particle size of the particles is set to 20 μm or less, discharge from the charging roller 1 to the photoreceptor can be appropriately caused, and thus, the image resolution can be effectively secured.

In the case where the particles included in the surface layer 4 are composed of a mixture of plural types of particles, the average particle size of the particles is an average particle size measured in a state in which the plural types of particles are mixed. The average particle size of the particles means a volume average particle size (Mv) determined by a laser diffraction-scattering method. In the case where the particles included in the surface layer 4 are composed of a mixture of plural types of particles, that is, the case where the shape of the particle size distribution curve of the particles included in the surface layer is multimodal, the average particle size of the particles is an average particle size measured in a state in which the plural types of particles are mixed.

In the present embodiment, the particles included in the surface layer 4 can be one type of particles but can be a mixture of plural types of particles. In the present embodiment, the particles are preferably composed of a mixture of plural types of particles, the plural types each having an average particle size different from that of the other types. In other words, the shape of the particle size distribution curve of the particles included in the surface layer 4 is preferably made multimodal. In this manner, for example, particles having a smaller particle size penetrate among particles having a larger particle size. Thus, the particles are more likely to be appropriately disposed on the surface of the surface layer 4, and the particle exposure area ratio is enabled to easily fall within a predetermined range.

In the particles included in the surface layer 4, in the case where the particles are a mixture of plural types of particles each having an average particle size different from that of the other types, it is preferred that the average particle size of the particles having the smallest average particle size be from 3 to 6 μm and the average particle size of the particles having the largest particle size be from 15 to 20 μm among the plural types of particles in the mixture.

In the present embodiment, the content of the particles contained in the surface layer 4 is preferably from 80 to 160 parts by mass, more preferably from 100 to 160 parts by mass, and further preferably from 100 to 140 parts by mass with respect to 100 parts by mass of a binder resin contained in the surface layer 4. When the content of the particles is set to 80 parts by mass or more, minute gaps can be made easily present uniformly across the entire surface layer 4 of the charging roller 1. When the content is set to 160 parts by mass or less, the storage stability of the raw material for layer formation for forming the charging roller 1 is easily secured.

Here, in the charging roller 1 of the present embodiment, as the raw material for layer formation constituting the portions other than the above particles in the surface layer 4, an ultraviolet curable resin composition including a urethane acrylate oligomer as the binder resin, a photopolymerization initiator, and a conductive agent can be used. Various additives may be blended to this raw material for layer formation as long as the objects of the present disclosure are not compromised.

As a urethane acrylate oligomer for use in the raw material for layer formation, there can be used a compound which is synthesized using, as a polyol, a highly pure polyol satisfying the following expression (I), $y \leq 0.6/x+0.01$ (I) wherein, x is a hydroxyl value of the polyol (mgKOH/g), and y is a total degree of unsaturation of the polyol (meq/g), singly or in combination with another polyol, the compound having one or more acryloyloxy group ($CH_2$=CHCOO—) and having a plurality of urethane bonds (—NHCOO—).

Such a urethane acrylate oligomer can be synthesized by, for example, (i) adding an acrylate having a hydroxyl group to a urethane prepolymer, synthesized from a single highly pure polyol or a mixture of a highly pure polyol and another polyol and polyisocyanate, or (ii) adding an acrylate having a hydroxyl group to a mixture of a urethane prepolymer synthesized from a single highly pure polyol or a mixture of a highly pure polyol and another polyol and polyisocyanate and a urethane prepolymer synthesized from another polyol and polyisocyanate. The highly pure polyol for use in synthesis of the urethane prepolymer can be synthesized by, for example, adding an alkylene oxide such as propylene oxide and ethylene oxide to a polyhydric alcohol such as ethylene glycol, propylene glycol, glycerin, neopentyl glycol, trimethylolpropane, pentaerythritol, and a compound obtained by allowing an alkylene oxide to react therewith, in the presence of a catalyst such as diethyl zinc, iron chloride, a porphyrin metal complex, a double metal cyanide complex, and a cesium compound. The synthesized highly pure polyol has a smaller amount of a monool byproduct such as an unsaturated end and has a purity higher than that of conventional polyols.

Forming a layer by ultraviolet radiation using a urethane acrylate oligomer synthesized using a highly pure polyol satisfying the relationship of the above expression (I) can reduce contamination on members adjacent to the charging roller 1 while reducing compression residual strain. From the viewpoint of achieving such an effect, the total degree of unsaturation of the highly pure polyol described above is preferably 0.05 meq/g or less, more preferably 0.025 meq/g or less, and further preferably 0.01 meq/g or less.

The highly pure polyol for use in synthesis of the urethane acrylate oligomer described above preferably has a weight-average molecular weight (Mw) of from 1,000 to 16,000. When the molecular weight of the highly pure polyol is set to 1,000 or more, the hardness of the layer is kept low, and thus, good image quality can be secured. On the other hand, when the molecular weight is set to 16,000 or less, an increase in the compression residual strain is suppressed, and thus, it is possible to prevent image defects due to deformation of the charging roller 1 from occurring.

In the synthesis of the urethane acrylate oligomer described above, other polyols that can be used along with the highly pure polyol described above are compounds having a plurality of hydroxyl groups, that is, OH groups, and specific examples include polyether polyol, polyester polyol, polybutadiene polyol, alkylene oxide-modified polybutadiene polyol, and polyisoprene polyol. The polyether polyol described above can be provided by, for example, adding an alkylene oxide such as ethylene oxide or propylene oxide to a polyhydric alcohol such as ethylene glycol, propylene glycol, or glycerin. The polyester polyol described above can be provided from, for example, a polyhydric alcohol such as ethylene glycol, diethylene glycol, 1,4-butanediol, 1,6-hexanediol, propylene glycol, trimethylolethane, or trimethylolpropane, and a polycarboxylic acid such as adipic acid, glutaric acid, succinic acid, sebacic acid, pimelic acid, or suberic acid. These polyols may be used singly or two or more of these may be blended for use.

In the synthesis of the urethane acrylate oligomer described above, when another polyol (a2) is used along with the highly pure polyol (a1) described above, the mass ratio between the highly pure polyol (a1) and the another polyol (a2) (a1/a2) is preferably in the range of from 100/0 to 30/70. When the ratio of the highly pure polyol (a1) with respect to the total amount of the highly pure polyol (a1) and another polyol (a2) (a1+a2) is set to 30% by mass or more, that is, when the ratio of the another polyol (a2) is set to 70% by mass or less, contamination on members adjacent to the photoreceptor and the like can be sufficiently reduced while the compression residual strain of the layer is reduced.

Polyisocyanates that can be used for the synthesis of the urethane acrylate oligomer described above are compounds having a plurality of isocyanate groups (NCO groups), and specific examples thereof include tolylene diisocyanate (TDI), diphenylmethane diisocyanate (MDI), crude diphenylmethane diisocyanate (crude MDI), isophorone diisocyanate (IPDI), hydrogenated diphenylmethane diisocyanate, hydrogenated tolylene diisocyanate, hexamethylene diisocyanate (HDI), and isocyanurate-modified products, carbodiimide-modified products, and glycol-modified products thereof. These polyisocyanates may be used singly or two or more of these may be blended for use.

In synthesis of the urethane acrylate oligomer described above, a catalyst for urethanation reaction is preferably used. Examples of such a catalyst for urethanation reaction include organic tin compounds such as dibutyltin dilaurate, dibutyltin diacetate, dibutyltin thiocarboxylate, dibutyltin dimaleate, dioctyltin thiocarboxylate, tin octenoate, and monobutyl tin oxide; inorganic tin compounds such as stannous chloride; organolead compounds such as lead octenoate; monoamines such as triethylamine and dimethyl cyclohexylamine; diamines tetramethylethylenediamine, tetramethylpropanediamine, and tetramethylhexanediamine; triamines such as pentamethyldiethylenetriamine, pentamethyldipropylenetriamine, and tetramethylguanidine; cyclic amines such as triethylenediamine, dimethylpiperazine, methylethylpiperazine, methylmorphiline, dimethylaminoethylmorpholine, dimethylimidazole, and pyridine; alcohol amines such as dimethylaminoethanol, dimethylaminoethoxyethanol, trimethylaminoethylethanolamine, methyl hydroxyethyl piperazine, and hydroxyethyl morpholine; ether amines such as bis(dimethylaminoethyl)ether and ethylene glycol bis(dimethyl) aminopropyl ether; organic sulfonic acids such as p-toluene sulfonic acid, methane sulfonic acid, and fluorosulfuric acid; inorganic acids such as sulfuric acid, phosphoric acid, and perchloric acid; bases such as sodium alcoholate, lithium hydroxide, aluminum alcoholate, and sodium hydroxide; titanium compounds such as tetrabutyl titanate, tetraethyl titanate, and tetraisopropyl titanate; bismuth compounds; and quaternary ammonium salts. Among these catalysts, organic tin compounds are preferred. These catalysts may be used singly or two or more of these may be used in combination. The amount of the catalyst described above to be used is in the range of from 0.001 to 2.0 parts by mass with respect to 100 parts by mass of the polyol described above.

An acrylate having a hydroxyl group that can be used for the synthesis of the urethane acrylate oligomer described above is a compound having one or more hydroxyl group(s) and one or more acryloyloxy group(s) ($CH_2{=}CHCOO{-}$). Such an acrylate having a hydroxyl group can be added to an isocyanate group of the urethane prepolymer described above. Examples of the acrylate having a hydroxyl group include 2-hydroxyethyl acrylate, 2-hydroxypropyl acrylate, and pentaerythritol triacrylate. These acrylates having a hydroxyl group may be used singly or two or more of these may be used in combination.

A photopolymerization initiator for use in the raw material for layer formation described above, when irradiated with ultraviolet rays, has a function of initiating polymerization of the urethane acrylate oligomer described above and further, of an acrylate monomer to be described below. Examples of such a photopolymerization initiator include such as 4-dimethylaminobenzoic acid, 4-dimethylaminobenzoic acid ester, 2,2-dimethoxy-2-phenylacetophenone, acetophenone diethyl ketal, alkoxy acetophenone, benzyl dimethyl ketal, benzophenone benzophenone derivatives such as 3,3-dimethyl-4-methoxybenzophenone, 4,4-dimethoxybenzophenone, and 4,4-diaminobenzophenone, alkyl benzoylbenzoate, bis(4-dialkylaminophenyl)ketones, benzyl and benzyl derivatives such as benzyl methyl ketal, benzoin and benzoin derivatives such as benzoin isobutyl ether, benzoin isopropyl ether, 2-hydroxy-2-methylpropiophenone, 1-hydroxycyclohexyl phenyl ketone, xanthone, thioxanthone, and thioxanthone derivatives, fluorene, 2,4,6-trimethylbenzoyldiphenylphosphine oxide, bis(2,6-dimethoxybenzoyl)-2,4,4-trimethylpentylphosphine oxide, bis(2,4,6-trimethylbenzoyl)-phenylphosphine oxide, and 2-methyl-1-[4-(methylthio)phenyl]-2-morpholinopropan-1, 2-benzyl-2-dimeth ylamino-1-(morpholinophenyl)-butanon-1. These photopolymerization initiators may be used singly or two or more of these may be used in combination.

A conductive agent to be used as the raw material for layer formation has a function of imparting an elastic layer with electrical conductivity. As such a conductive agent, those that can transmit ultraviolet rays are preferred. An ion conductive agent or a transparent electron conductive agent is preferably used, and an ion conductive agent is particularly preferably used. An ion conductive agent dissolves in the urethane acrylate oligomer described above and also has transparency. Thus, when an ion conductive agent is used as the conductive agent, even if the raw material for layer formation is applied thick on the shaft member, ultraviolet rays reach inside the coating film to thereby enable the raw material for layer formation to be sufficiently cured. Here, examples of the ion conductive agent include ammonium salts, such as perchlorates, chlorates, hydrochlorides, bromates, iodates, fluoroborates, sulfates, ethylsulfonates, carboxylates and sulfonates of tetraethylammonium, tetrabutylammonium, dodecyltrimethylammonium, hexadecyltrimethylammonium, benzyltrimethylammonium, and modified fatty acid dimethylethylammonium; and perchlorates, chlorates, hydrochlorides, bromates, iodates, fluoroborates, sulfates, trifluoromethylsulfates, and sulfonates of alkali metals and alkaline earth metals, such as lithium, sodium, potassium, calcium, and magnesium. Examples of the transparent electron conductive agent include particulates of a metal oxide such as ITO, tin oxide, titanium oxide, and zinc oxide; particulates of a metal such as nickel, copper, silver, and germanium; and conductive whiskers such as conductive titanium oxide whisker and conductive barium titanate whisker. Further, as the electron conductive agent, conductive carbon such as Ketjen black and acetylene black, carbon blacks for rubbers, such as SAF, ISAF, HAF, FEF, GPF, SRF, FT, and MT, carbon black for colors subjected to oxidization treatment or the like, pyrolytic carbon black, natural graphite, artificial graphite, or the like may be used. These conductive agents may be used singly or two or more of these may be used in combination.

The raw material for layer formation described above preferably further includes an acrylate monomer. The acrylate monomer is a monomer having one or more acryloyloxy group(s) ($CH_2$=CHCOO—), functions as a reactive diluent, in other words, is cured by ultraviolet rays, and additionally can lower the viscosity of the raw material for layer formation. The number of functional groups of the acrylate monomer is from 1.0 to 10 and more preferably from 1.0 to 3.5. The molecular weight of the acrylate monomer is preferably from 100 to 2,000 and more preferably from 100 to 1,000.

Examples of the acrylate monomer described above include isomyristyl acrylate, methoxytriethylene glycol acrylate, ethyl acrylate, isobutyl acrylate, n-butyl acrylate, isoamyl acrylate, glycidyl acrylate, butoxyethyl acrylate, ethoxy diethylene glycol acrylate, methoxy dipropylene glycol acrylate, phenoxyethyl acrylate, 2-hydroxyethyl acrylate, 2-hydroxypropyl acrylate, and pentaerythritol triacrylate. These acrylate monomers may be used singly or two or more of these may be used in combination.

In the raw material for layer formation described above, the mass ratio between the urethane acrylate oligomer and the acrylate monomer, that is, urethane acrylate oligomer/acrylate monomer, is preferably in the range of from 100/0 to 10/90. When the ratio of the urethane acrylate oligomer with respect to the total amount of the urethane acrylate oligomer and the acrylate monomer is set to 10% by mass or more, that is, the ratio of the acrylate monomer is set to 90% by mass or less, it is possible to provide a base layer 3 having a low hardness and low compression residual strain suitable for the charging roller 1.

The amount of the photopolymerization initiator to be blended in the raw material for layer formation described above is preferably in the range of from 0.2 to 5.0 parts by mass with respect to the total 100 parts by mass of the urethane acrylate oligomer and the acrylate monomer described above. When the amount of the photopolymerization initiator to be blended is set to 0.2 parts by mass or more, an effect of initiating ultraviolet curing of the raw material for layer formation can be securely provided. On the other hand, when the amount is set to 5.0 parts by mass or less, physical properties such as compression residual strain are prevented from decreasing, and thus, the cost efficiency of the raw material for layer formation can be enhanced.

Further, the amount of the conductive agent to be blended in the raw material for layer formation described above is preferably in the range of from 0.1 to 5.0 parts by mass with respect to the total 100 parts by mass of the urethane acrylate oligomer and the acrylate monomer described above. When the amount of the conductive agent to be blended is set to 0.1 parts by mass or more, the electrical conductivity of the layer is sufficiently secured, and the charging roller 1 can be imparted with a desired electrical conductivity. On the other hand, when the amount is set to 5.0 parts by mass or less, the electrical conductivity of the layer is appropriately suppressed, the physical properties such as compression residual strain are prevented from decreasing, and thus, a good image can be secured.

To the raw material for layer formation described above, 0.001 to 0.2 parts by mass of a polymerization inhibitor may be further added with respect to the total 100 parts by mass of the urethane acrylate oligomer and the acrylate monomer described above. Addition of the polymerization inhibitor can prevent thermal polymerization before ultraviolet irradiation. Examples of the polymerization inhibitor include hydroquinone, hydroquinone monomethyl ether, p-methoxyphenol, 2,4-dimethyl-6-t-butylphenol, 2,6-di-t-butyl-p-cresol, butyl hydroxy anisole, 3-hydroxy thiophenol, α-nitroso-β-naphtol, p-benzoquinone, and 2,5-dihydroxy-p-quinone.

The thickness of the surface layer 4 is preferably from 5 to 10 μm. When the thickness of the surface layer 4 is 5 μm or more, the particles are more likely to be sufficiently retained. On the other hand, when the thickness is 10 μm or less, particles that are contained inside without being exposed from the surface of the surface layer 4 can be reduced.

Figure 2:
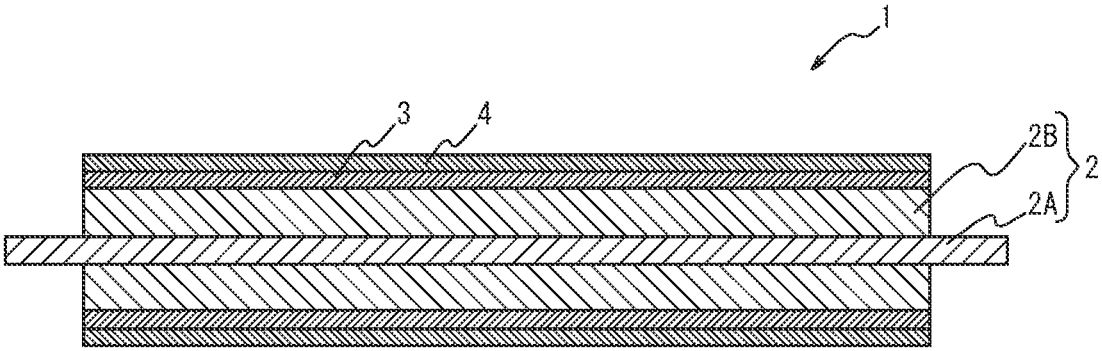
FIG. 2 is a cross-sectional view illustrating a charging roller according to one embodiment of the present disclosure via a cross section along the axis direction.

Next, in FIG. 2, the shaft member 2 is composed of a metal shaft 2A and a highly rigid resin base 2B arranged outside in the radial direction thereof. The shaft member 2 of the charging roller 1 of the present embodiment is not particularly limited as long as the shaft member 2 has a good electrical conductivity. The shaft member 2 may be constituted only by the metal shaft 2A, may be constituted only by the highly rigid resin base 2B, or may be a metal or highly rigid resin cylinder the inside of which is hollowed out.

When a highly rigid resin is used for the shaft member 2, it is preferred that a conductive agent be added and dispersed in the highly rigid resin to thereby sufficiently secure the electrical conductivity. Here, as the conductive agent to be dispersed in the highly rigid resin, powdery conductive agents such as carbon black powder and graphite powder, carbon fiber, metal powders such as aluminum, copper, and nickel, metal oxide powders such as tin oxide, titanium oxide, and zinc oxide, and electrical conductivity glass powder are preferred. These conductive agents may be used singly or two or more of these may be used in combination. The amount of the conductive agent to be blended is not particularly limited, but is preferably in the range of from 5 to 40% by mass and more preferably in the range of 5 to 20% by mass with respect to the total highly rigid resin.

Examples of the material of the metal shaft 2A or metal cylinder described above include iron, stainless steel, and aluminum. Examples of the material of the highly rigid resin base 2B described above include polyacetal, polyamide 6, polyamide 6.6, polyamide 12, polyamide 4.6, polyamide 6.10, polyamide 6.12, polyamide 11, polyamide MXD6, polybutylene terephthalate, polyphenylene oxide, polyphenylene sulfide, polyether sulfone, polycarbonate, polyimide, polyamide-imide, polyether-imide, polysulfone, polyetheretherketone, polyethylene terephthalate, polyarylate, liquid crystal polymer, polytetrafluoroethylene, polypropylene, ABS resin, polystyrene, polyethylene, melamine resin, phenol resin, and silicone resin. Among these, polyacetal, polyamide 6.6, polyamide MXD6, polyamide 6.12, polybutylene terephthalate, polyphenylene ether, polyphenylene sulfide, and polycarbonate are preferred. These highly rigid resins may be used singly or two or more of these may be used in combination.

When the shaft member 2 described above is a metal shaft or a shaft member including a highly rigid resin base arranged outside thereof, the outer diameter of the metal shaft is preferably in the range of from 4.0 to 8.0 mm. Alternatively, the shaft member 2 is a shaft member including a highly rigid resin base arranged outside of the metal shaft, the outer diameter of the resin base is preferably in the range of from 10 to 25 mm. Use of a highly rigid resin in the shaft member 2 can suppress an increase in the mass of the shaft member 2 even if the outer diameter of the shaft member 2 is enlarged.

The charging roller 1 of the present embodiment comprises a base layer 3 located outside in the radial direction of the shaft member 2. As the raw material for layer formation constituting the base layer 3, a raw material for layer formation similar to that constituting the surface layer 4 described above can be used provided that the particles contained in the surface layer 4 are not an essential constituent.

The base layer 3 formed of the raw material for layer formation described above preferably has an Asker C hardness of from 30 degrees to 70 degrees. Here, the Asker C hardness is a value determined by measurement at a flat portion of a cylindrical sample having a height of 12.7 mm and a diameter of 29 mm. When the Asker C hardness is 30 degrees or more, a sufficient hardness for the charging roller 1 can be secured. On the other hand, when the Asker C hardness is 70 degrees or less, the conformability to other rollers and blades becomes good.

The base layer 3 preferably has a compression residual strain, that is, a compression set, of 3.0% or less. Here, the compression residual strain can be measured in compliance with JIS K 6262 (1997), and specifically, can be determined by compressing a cylindrical sample having a height of 12.7 mm and a diameter of 29 mm by 25% in the height direction under specified thermal treatment conditions, that is, at 70° C. for 22 hours. When the compression residual strain of the base layer 3 is 3.0% or less, indentation due to other members becomes unlikely to occur on the surface of the charging roller 1, and thus, streaky image defects become unlikely to occur in the image formed.

The thickness of the base layer 3 is preferably from 1 to 3,000 μm. When the thickness of the base layer 3 is 1 μm or more, the charging roller 1 will have sufficient elasticity. On the other hand, when the thickness is 3,000 μm or less, ultraviolet rays reach sufficiently deep into the base layer 3 in ultraviolet irradiation. Then, the raw material for layer formation can be securely ultraviolet-cured, and thus, the amount of an expensive ultraviolet curable resin raw material to be used can be reduced.

Furthermore, the specific resistance of the base layer 3 is preferably, but not particularly limited to, from $10^4$ to $10^8\Omega$. Here, the resistance value can be determined from a current value obtained by pressing the outer circumferential surface of a roller in which only the base layer 3 is formed on the outer circumferential surface of the shaft member 2 onto a flat or cylindrical counter electrode and applying a voltage of 300 V between the shaft member 2 and the counter electrode.

When the base layer 3 is formed of the raw material for layer formation described above, the charging roller 1 of the present embodiment can be easily produced by applying the raw material for layer formation described above onto the outer surface of the shaft member 2, then irradiating the applied raw material with ultraviolet rays to form the base layer 3, further applying the raw material for layer formation described above including the plurality of particles described above onto the surface of the formed base layer 3, and irradiating the applied raw material with ultraviolet rays to form the surface layer 4. Accordingly, the charging roller 1 of the present embodiment can be produced in a short period without the need for a large amount of thermal energy. Additionally, large equipment costs are not required because a curing oven and the like are not required for the production. Examples of a method of applying the raw material for layer formation onto the outer surface of the shaft member 2 or the surface of the base layer 3 include a spraying method, a roll coater method, a dipping method, a die coating method. Examples of a light source for use in ultraviolet irradiation include a mercury lamp, a high-pressure mercury lamp, an ultrahigh-pressure mercury lamp, a metal halide lamp, and a xenon lamp. Ultraviolet irradiation conditions are appropriately selected in accordance with the components included in the raw material for layer formation, the composition of the raw material, the amount of the raw material to be applied, and the like, and the irradiation intensity and the integral light intensity, and the like are only required to be adjusted appropriately.

In the charging roller 1 of the present embodiment, the base layer 3 also may be formed of polyurethane foam. In this case, for example, the base layer 3 made of polyurethane foam can be supported directly outside in the radial direction of the metal shaft 2A.

As the polyurethane resin for use in the polyurethane foam constituting the base layer 3, which is not particularly limited, conventionally known materials can be appropriately selected for use. The expansion ratio of the polyurethane foam is, but not particularly limited to, from 1.2 to 50 times, particularly preferably from of the order of 1.5 to 10 times, and the foam density is preferably from of the order of 0.1 to 0.7 g/cm$^3$.

A conductive agent can be added to the polyurethane foam constituting the base layer 3. Thereby, an electrical conductivity is imparted or adjusted to achieve a predetermined resistance value. Such a conductive agent is not particularly limited. A conductive agent similar to one that can be blended to the ultraviolet curable resin described above can be appropriately used singly, or two or more of such conductive agents may be appropriately used in combination. The amount of these conductive agents to be blended is appropriately selected in accordance with the type of composition and is usually adjusted such that the specific resistance of the base layer 3 falls within the range mentioned above.

To this base layer 3, known additives such as a water-resistant agent, a humectant, a foaming agent, a foam stabilizer, a curing agent, a thickener, an antifoaming agent, a leveling agent, a dispersant, a thixotropy imparting agent, an antiblocking agent, a crosslinking agent, and a film-forming aid can be added in an appropriate amount, as needed, in addition to the conductive agent described above.

The thickness of the base layer 3 in this case is preferably from 1.0 to 5.0 mm and more preferably from 1.0 to 3.0 mm. Setting the thickness of the base layer 3 to the range described above can prevent spark discharge.

When the base layer 3 is formed of polyurethane foam, the charging roller 1 of the present embodiment can be produced by allowing polyurethane foam to be supported on the outer circumference of the shaft member 2 by die molding or the like using a cylindrical mold, then applying the raw material for layer formation described above including the particles described above onto the surface of the base layer 3 formed of this polyurethane foam, and subjecting the applied raw material to ultraviolet irradiation to form the surface layer 4. The method for applying the raw material for layer formation described above, the light source for ultraviolet irradiation, and the irradiation conditions in this case can be the same as those described above and are not particularly limited.

In the charging roller 1 of the present embodiment, when an intermediate layer is provided between the base layer 33 and the surface layer 4, the material of the intermediate layer is not particularly limited. A moisture-curable type resin may be used, and an ultraviolet-curable type resin in which an amide-containing monomer such as an acryloyl morpholine monomer is blended to an oligomer including an acrylate may be used.

The specific resistance of the charging roller 1 of the present embodiment is preferably $10^4$ to $10^8\Omega$. Here, the specific resistance can be determined from a current value obtained by pressing the outer circumferential surface of the roller on a flat or cylindrical counter electrode and applying a voltage of 300 V between the shaft member 2 and the counter electrode.

A partial cross-sectional view of an image forming apparatus comprising the charging roller 1 of the embodiment mentioned above according to one embodiment of the present disclosure is illustrated in FIG. 1. The image forming apparatus illustrated comprises a photoreceptor 10 supporting an electrostatic latent image, a charging roller 1 that is located in the vicinity of, that is, above in the figure, the photoreceptor 10 to charge the photoreceptor 10, a toner supplying roller 12 for supplying toner 11, a developing roller 13 disposed between the toner supplying roller 12 and the photoreceptor 10, a layer forming blade 14 provided in the vicinity of, that is, above in the figure, the developing roller 13, a transfer roller 15 located in the vicinity of, that is, below in the figure, the photoreceptor 10, and a cleaning roller 16 disposed adjacent to the photoreceptor 10. The image forming apparatus illustrated can further comprise known components, not illustrated, usually used in image forming apparatuses.

In the image forming apparatus illustrated, first, the charging roller 1 is caused to abut on the photoreceptor 10, a voltage is applied between the photoreceptor 10 and the charging roller 1, and the photoreceptor 10 is charged to a constant potential. Then, an electrostatic latent image is formed on the photoreceptor 10 by an exposure apparatus, not illustrated. Next, the photoreceptor 10, the toner supplying roller 12, and the developing roller 13 rotate in the arrow direction in the figure to thereby feed the toner 11 on the toner supplying roller 12 via the developing roller 13 to the photoreceptor 10. The toner 11 on the developing roller 13 is adjusted in a uniform thin layer by the layer forming blade 14. The developing roller 13 rotates while being in contact with the photoreceptor 10, and thus the toner adheres from the developing roller 13 to the electrostatic latent image on the photoreceptor 10, and thereby the latent image is visualized. The toner adhering to the latent image is transferred by the transfer roller 15 on to a recording medium such as paper. Toner remaining on the photoreceptor 10 after the transfer is removed by the cleaning roller 16.

Then, the image forming apparatus of the present embodiment can sufficiently reduce microjitter because of comprising the charging roller 1 described above of the present embodiment.

The embodiment of the present disclosure has been described hereinabove in reference with the drawings, but the charging roller and the image forming apparatus of the present disclosure are not limited to the examples described above. The charging roller and the image forming apparatus of the present embodiment may be modified appropriately.

EXAMPLES

Hereinafter, the present disclosure will be described further specifically by way of examples, but the present disclosure is not limited to the following examples in any way.

First, materials used for producing charging rollers of Examples and Comparative Examples will be described.

(Urethane Acrylate Oligomer) 100 parts by mass of a bifunctional highly pure polyol having a molecular weight of 4,000 (PREMINOL S-X4004, manufactured by Asahi Glass Co., Ltd., a polyol constituted by a PO chain, hydroxyl value=27.9 mgKOH/g, total degree of unsaturation=0.007 meq/g, the right side of the expression (I) (0.6/x+0.01) =0.03), 8.29 parts by mass of isophorone diisocyanate (isocyanate groups/hydroxyl groups of polyol=3/2=1.50 (molar ratio)), and 0.01 parts by mass of dibutyltin dilaurate were allowed to react at 70° C. for two hours while being stirred and mixed under warming to thereby synthesize a urethane prepolymer having an isocyanate group at each end of the molecular chain. Further, 2.88 parts by mass of 2-hydroxyethyl acrylate (HEA) were stirred and mixed into 100 parts by mass of this urethane prepolymer, and the mixture was allowed to react at 70° C. for two hours to thereby synthesize a urethane acrylate oligomer having a molecular weight of 9,000. The urethane acrylate oligomer obtained had a viscosity at 25° C. measured with a B-type viscometer of 80,000 mPas/sec.

(Photopolymerization Initiator)

IRGACURE 819 (manufactured by BASF Japan Ltd.)

(Conductive Agent)

Conductive agent (i): potassium metal ion

Conductive agent (ii): acetylene black, manufactured by Mitsubishi Chemical Corporation (Particles)

Particles (i): acryl particles, manufactured by Soken Chemical & Engineering Co., Ltd. KMR-3TA, average particle size: 3 μm Particles (ii): acryl particles, manufactured by Negami Chemical Industrial Co., Ltd., SE-006T, average particle size: 6 μm Particles (iii): acryl particles, manufactured by Negami Chemical Industrial Co., Ltd., SE-010T, average particle size: 10 μm Particles (iv): acryl particles, manufactured by Negami Chemical Industrial Co., Ltd., GR-400, average particle size: 15 μm Particles (v): acryl particles, manufactured by Negami Chemical Industrial Co., Ltd., SE-020T, average particle size: 20 μm Particles (vi): acryl particles, manufactured by Negami Chemical Industrial Co., Ltd., SE-030T, average particle size: 30 μm Particles (vii): nylon particles manufactured by Toray Industries, Inc., TR-2, average particle size: 15 μm Particles (viii): melamine particles manufactured by NIPPON SHOKUBAI CO., LTD., EPOSTAR M30, average particle size: 3 μm (Examples and Comparative Examples)

A raw material for layer formation obtained by blending 3 parts by mass of the photopolymerization initiator and 3 parts by mass of the conductive agent (i) with respect to 100 parts by mass of the urethane acrylate oligomer described above was applied at a thickness of 1,500 μm with a die coater onto the outer surface on the metal shaft having an outer diameter of 6.0 mm and cured by spot UV irradiation during application to thereby form a base layer. The thus obtained roller including the base layer formed was further irradiated with UV at a UV irradiation intensity of 700 mW/cm$^2$ for five seconds while being rotated under a nitrogen atmosphere.

Subsequently, a raw material for layer formation obtained by blending 3 parts by mass of the photopolymerization initiator, 3 parts by mass of the conductive agent (ii), and particles of the type and content given in Table 1 with respect to 100 parts by mass of the urethane acrylate oligomer described above was applied onto the surface of the obtained roller including the base layer formed with a roll coater and irradiated with UV to form a surface layer at a thickness of 6 μm. Thereby, sample rollers of Examples and Comparative Examples were each provided. Results of evaluating each of the sample rollers according to the following are given in Table 1 below.

(Microjitter)

Each sample roller, as the charging roller, was attached to a cartridge and left under an atmosphere of a temperature of 30° C. and a humidity of 80% and a temperature of 10° C. and a humidity for 24 hours. Thereafter, the cartridge was installed in an actual machine, and 5000 sheets were printed. Printing under 40% halftone image (screen lines: 150 to 200) conditions was conducted on four sheets: the 1st, 2nd, 4999th, and 5000th sheets. Then, microjitter (horizontal streaks) was evaluated in accordance with the following criteria. The results are given in Table 1.

Excellent: Microjitter does not occur or is too faint to view.

Fair: Slight microjitter occurs in a portion of the halftone image.

Poor: Dense microjitter occurs in a portion or the entire surface of the halftone image.

(Image Resolution)

Similarly to the microjitter evaluation described above, each sample roller, as the charging roller, was attached to a cartridge and left under an atmosphere of a temperature of 23° C. and a humidity of 50% for 24 hours. Thereafter, the cartridge was installed in an actual machine, a halftone image (screen lines: 150 to 200) was printed, and the image resolution was evaluated in accordance with the following criteria. The results are given in Table 1.

Excellent: The image is good without minute dot missing.

Poor: Minute dot missing is present in the entire image, and white spots are visible.

TABLE 1

| | | | | Example 1 | Example 2 | Example 3 | Example 4 | Example 5 | Example 6 |
|---|---|---|---|---|---|---|---|---|---|
| Surface layer | Particles (i) | 3 μm-particle size acryl particles | Parts by mass* | — | — | — | 33 | — | — |
| | Particles (ii) | 6 μm-particle size acryl particles | | 160 | 67 | 33 | — | 33 | 33 |
| | Particles (iii) | 10 μm-particle size acryl particles | | — | 33 | — | — | — | — |
| | Particles (iv) | 15 μm-particle size acryl particles | | — | — | — | — | 67 | — |
| | Particles (v) | 20 μm-particle size acryl particles | | — | — | 67 | 67 | — | — |
| | Particles (vi) | 30 μm-particle size acryl particles | | — | — | — | — | — | — |
| | Particles (vii) | 15 μm-particle size nylon particles | | — | — | — | — | — | 70 |
| | Particles (viii) | 3 μm-particle size melamine particles | | — | — | — | — | — | — |
| | Average particle size: (volume average) | | μm | 6 | 7.3 | 15.3 | 14.3 | 12.0 | 12.1 |
| | Ratio of total area of exposed particles | | % | 90 | 78 | 74 | 71 | 77 | 63 |
| Effect | Microjitter | | — | Excellent | Excellent | Excellent | Excellent | Excellent | Fair |
| | Image resolution | | — | Excellent | Excellent | Excellent | Excellent | Excellent | Excellent |

TABLE 1-continued

| | | | Example 7 | Example 8 | Comparative Example 1 | Comparative Example 2 |
|---|---|---|---|---|---|---|
| Surface layer | Particles (i) | 3 μm-particle size acryl particles | — | 50 | — | — |
| | Particles (ii) | 6 μm-particle size acryl particles | — | — | 67 | 33 |
| | Particles (iii) | 10 μm-particle size acryl particles | — | — | — | — |
| | Particles (iv) | 15 μm-particle size acryl particles | — | — | — | 42 |
| | Particles (v) | 20 μm-particle size acryl particles | 67 | — | — | — |
| | Particles (vi) | 30 μm-particle size acryl particles | — | 67 | — | — |
| | Particles (vii) | 15 μm-particle size nylon particles | — | — | — | — |
| | Particles (viii) | 3 μm-particle size melamine particles | 27 | — | — | — |
| | Average particle size: (volume average) | | 15.1 | 19.7 | 6 | 11.0 |
| | Ratio of total area of exposed particles | | 77 | 65 | 54 | 53 |
| Effect | Microjitter | | Excellent | Excellent | Poor | Poor |
| | Image resolution | | Excellent | Poor | Excellent | Excellent |

*The content of the particles (parts by mass) is based on 100 parts by weight of the binder resin.

It can be seen from Table 1 that microjitter has been sufficiently reduced in Examples having a particle exposure area ratio of more than 60%. It also can be seen that microjitter has been effectively reduced while the image resolution is secured in Examples 1 to 8, in which the average particle size of the particles is from 3 to 20 μm.

INDUSTRIAL APPLICABILITY

According the present disclosure, it is possible to provide a charging roller capable of sufficiently reducing microjitter and an image forming apparatus capable of sufficiently reducing microjitter.

REFERENCE SIGNS LIST

1 charging roller
2 shaft member
3 base layer
4 surface layer
10 photoreceptor
11 toner
12 toner supplying roller
13 developing roller
14 layer forming blade
15 transfer roller
16 cleaning roller

The invention claimed is:

1. A charging roller comprising a shaft member, a base layer located outside in a radial direction of the shaft member, and a surface layer located outside in a radial direction of the base layer and forming a surface, wherein the surface layer includes particles, an average particle size of the particles is from 3 to 20 μm and greater than a thickness of the surface layer, and a ratio of a total area of the particles exposed from a surface of the surface layer in a planar view seen from a radial direction of the charging roller, with respect to an area of the surface of the surface layer is more than 60%.

2. The charging roller according to claim 1, wherein the particles are formed of at least one resin selected from the group consisting of an acrylic resin, a polyamide resin, and a melamine resin.

3. The charging roller according to claim 2, wherein the thickness of the surface layer is from 5 to 10 μm.

4. The charging roller according to claim 2, wherein a specific resistance of the charging roller is from $10^4$ to $10^8\Omega$.

5. An image forming apparatus comprising the charging roller according to claim 2.

6. The charging roller according to claim 1, wherein the particles are composed of a mixture of plural types of particles each having an average particle size different from that of the other types.

7. The charging roller according to claim 6, wherein the thickness of the surface layer is from 5 to 10 μm.

8. The charging roller according to claim 6, wherein a specific resistance of the charging roller is from $10^4$ to $10^8\Omega$.

9. An image forming apparatus comprising the charging roller according to claim 6.

10. The charging roller according to claim 1, wherein the thickness of the surface layer is from 5 to 10 μm.

11. The charging roller according to claim 10, wherein a specific resistance of the charging roller is from $10^4$ to $10^8\Omega$.

12. An image forming apparatus comprising the charging roller according to claim 10.

13. The charging roller according to claim 1, wherein a specific resistance of the charging roller is from $10^4$ to $10^8\Omega$.

14. An image forming apparatus comprising the charging roller according to claim 13.

15. An image forming apparatus comprising the charging roller according to claim 1.

* * * * *